US011028489B2

(12) United States Patent
Hatle

(10) Patent No.: US 11,028,489 B2
(45) Date of Patent: Jun. 8, 2021

(54) SURFACE TREATMENT COMPOSITION AND METHODS FOR USE

(71) Applicant: CORROSION EXCHANGE LLC, Humble, TX (US)

(72) Inventor: Loren L. Hatle, Houston, TX (US)

(73) Assignee: CORROSION EXCHANGE LLC, Humble, TX (US)

( * ) Notice: Subject to any disclaimer, the term of this patent is extended or adjusted under 35 U.S.C. 154(b) by 0 days.

(21) Appl. No.: 16/832,699

(22) Filed: Mar. 27, 2020

(65) Prior Publication Data

US 2020/0308714 A1 Oct. 1, 2020

Related U.S. Application Data

(60) Provisional application No. 62/826,610, filed on Mar. 29, 2019.

(51) Int. Cl.

| | |
|---|---|
| ***C23G 5/036*** | (2006.01) |
| ***C23G 1/16*** | (2006.01) |
| ***B24C 7/00*** | (2006.01) |
| ***C23G 1/19*** | (2006.01) |

(52) U.S. Cl.

CPC ..... *C23G 5/036* (2013.01); *B24C 7/0076* (2013.01); *C23G 1/16* (2013.01); *C23G 1/19* (2013.01)

(58) Field of Classification Search

CPC .. C23G 5/036; C23G 1/16; C23G 1/19; B24C 7/0076

See application file for complete search history.

(56) References Cited

U.S. PATENT DOCUMENTS

| | | | | |
|---|---|---|---|---|
| 2,463,837 A | | 3/1949 | Weinrich | |
| 2,538,702 A | | 1/1951 | Noble et al. | |
| 3,368,913 A | | 2/1968 | Ziehr et al. | |
| 3,529,999 A | | 9/1970 | Boeniger | |
| 3,684,720 A | | 8/1972 | Richardson | |
| 4,104,806 A | * | 8/1978 | Reusch | F26B 3/088 264/117 |
| 4,234,442 A | | 11/1980 | Cornelissens | |
| 4,622,161 A | | 11/1986 | Cornelissens et al. | |
| 5,160,654 A | | 11/1992 | Falou et al. | |
| 5,259,984 A | | 11/1993 | Hull | |
| 5,317,841 A | * | 6/1994 | Cook | B08B 3/02 451/38 |

(Continued)

FOREIGN PATENT DOCUMENTS

WO 2014089196 6/2014

OTHER PUBLICATIONS

International Search Report and Written Opinion for international application No. PCT/US2020/025323 dated Jun. 9, 2020.

*Primary Examiner* — Mark Eashoo
*Assistant Examiner* — M. Reza-Asdjodi
(74) *Attorney, Agent, or Firm* — Edmonds & Cmaidalka, P.C.

(57) ABSTRACT

Embodiments of the present disclosure provide a surface treatment composition and methods for using same. The composition for removing contaminants from a metallic surface, can include 3 wt % to 40 wt % of at least one bifunctional alkaline compound, 0.03 wt % to 10 wt % of at least one oxidizer comprising a metal salt, and water, where all weight percentages are based on the total weight of the composition.

13 Claims, 4 Drawing Sheets

(56) References Cited

U.S. PATENT DOCUMENTS

| | | | | |
|---|---|---|---|---|
| 5,441,441 | A | 8/1995 | Cook et al. | |
| 5,462,697 | A | 10/1995 | Yianakopoulos | |
| 5,527,203 | A * | 6/1996 | Cook | B08B 3/02 451/38 |
| 6,190,738 | B1 | 2/2001 | Beck | |
| 7,541,322 | B2 * | 6/2009 | Ikemoto | C11D 3/2075 134/1.3 |
| 9,193,943 | B1 * | 11/2015 | Hatle | C11D 3/04 |
| 9,782,804 | B1 * | 10/2017 | Hatle | C23G 1/02 |
| 10,030,310 | B1 * | 7/2018 | Hatle | C23G 1/00 |
| 2003/0162685 | A1 | 8/2003 | Man et al. | |
| 2003/0226621 | A1 * | 12/2003 | Maeda | C23C 22/60 148/243 |
| 2004/0002433 | A1 | 1/2004 | Buckland et al. | |
| 2005/0245412 | A1 | 11/2005 | Shah et al. | |
| 2007/0065587 | A1 * | 3/2007 | Hatle | C23G 1/088 427/299 |
| 2009/0048141 | A1 | 2/2009 | Spadoni et al. | |
| 2009/0214606 | A1 * | 8/2009 | Bujard | A23G 4/064 424/401 |
| 2010/0170534 | A1 | 7/2010 | Hatle et al. | |
| 2011/0033532 | A1 * | 2/2011 | Angel | A61K 9/2853 424/465 |
| 2011/0210049 | A1 | 9/2011 | O'regan, Jr. | |
| 2012/0291815 | A1 | 11/2012 | Monsrud et al. | |
| 2017/0165818 | A1 * | 6/2017 | Zimmermann | B25B 23/12 |
| 2018/0237727 | A1 * | 8/2018 | Nakajima | C11D 3/3757 |

* cited by examiner

SURFACE TREATMENT COMPOSITION AND METHODS FOR USE

CROSS-REFERENCE TO RELATED APPLICATIONS

This application claims priority to U.S. Provisional patent application having Ser. No. 62/826,610, filed on Mar. 29, 2019. The entirety of which is incorporated by reference herein.

BACKGROUND

Field of the Invention

Embodiments of the present disclosure generally relate to cleaning and decontaminating surfaces. More particularly, embodiments of the present disclosure relate to a surface treatment composition and uses thereof.

Description of the Related Art

Corrosion plays a critical role in the costs associated with maintenance and replacement of vessels, pipes, pipelines, wellbore, equipment, and other structures. Such structures are perpetually degraded by the negative impacts of corrosion from the very first day of service. The costs to maintain these structures can exceed the initial cost of the structure itself. In addition, corrosion reduces the effective service life of the structure, which further increases costs.

Direct costs of corrosion include all activities throughout the service life of a structure that are performed to prevent corrosion, repair corrosion damage, and replace the structure. These activities can include design, manufacturing, maintenance, inspection, repair, rehabilitation, and removal. Service downtime associated with maintenance, inspection, repair, rehabilitation, and removal also produce large direct costs due to the impacts of corrosion. Liability costs associated with structural failures due corrosion can be exorbitant, such as partial or total loss of the structure itself, damage to nearby structures, environmental contamination, and severe injuries to nearby people. In particular, environmental hazards caused by corrosion failures pose a significant danger to the public. Furthermore, the effects of corrosion are accelerated when substandard materials and inferior processes are used to manufacture a structure.

Corrosion may occur when chemical contaminants (e.g., iron sulfide, iron chloride, acids, bases, oxidizers, or the like) and/or microbiological contaminants (e.g., sulfate reducing bacteria, acid producing bacteria, oxidation bacteria, or the like) contact a surface and destroy the surface itself and/or destroy the coating applied to the surface. Contaminants generally exist on the outermost layer of a surface but can also penetrate the surface. Contaminants are generally visible on a surface when significant corrosion has occurred, but are otherwise not visible when only small amounts of contaminants exist on the surface.

Conventional responses to corrosion include various surface blasting processes and/or applications of anti-corrosion coating materials. Surface blasting processes typically begin with careful cleaning of surfaces to a visual standard, such as those specified by the National Association of Corrosion Engineers (hereafter, "NACE") or the Society for Protective Coatings (hereafter, "SSPC"). These standards of cleanliness result in a surface that when viewed without magnification appear to be free of all visible sources of contamination (e.g., oil, grease, dust, dirt, mill scale, rust, coating, oxides, corrosion products, or the like). The level of visual cleanliness required can depend upon the purpose of the structure, the structure material, and the specifications of any coatings to be applied. Generally, the blasting process will use a blasting abrasive that can include silica sand or equivalent material that is dry, neutral pH, and free of dust, clay, or other foreign materials. However, blasting processes cannot remove all contaminants, even with repeated blasting.

After the blasting process, it is typically necessary to control the environment of the structure surface to allow for effective application of a coating. Environmental control is generally costly requiring increased downtime and equipment such as industrial desiccant dryers. Additionally, the environment can require cooling and/or dehumidification. Dehumidification processes can be necessary to delay corrosion prior to application of a coating. However, dehumidification does not prevent corrosion or contact with new contaminants, thus additional blasting processes may be required. After each blasting process further dehumidification processes may be needed until the desired surface conditions are achieved for coating. This repeat process of blasting and environmental control can add significant delays to the overall maintenance downtime, thereby adding significant costs.

A common method of preventing subsequent corrosion or contact with new contaminants after a blasting process is to apply a holding primer. A holding primer is a surface treatment that prevents rusting or oxidation from environmental contaminants contacting the surface until a finished coating can be applied. The holding primer can eliminate some of the repeated blasting and dehumidification process steps. However, the immediate application of a holding primer only prevents environmental sources of corrosion or contact with new contaminants after the blasting process, it cannot prevent corrosion from contaminants that remain on the surface after blasting. Rather, contaminants become entrapped by the holding primer and continue to corrode both the surface and the holding primer.

Coatings applied to a surface are intended to preserve the surface and prevent corrosion when the surface contacts contaminants. Coatings have a limited duration before the surface must be prepared for another coating application. The lifetime of any coating is significantly reduced when the coated surface still contains contaminants. The contaminants can corrode the underlying surface, corrode the applied coating, or produce physical conditions (e.g., increased pressure under the coating, coating blistering, surface pitting, surface or coating grooving, or the like) that cause the applied coating to fail. Furthermore, because the remaining contaminants exist in unknown quantities and because coating applications are designed for a surface free of contaminants, the applied coatings fail at an accelerated rate with no means to predict the failure rate. As a result, contaminants that remain under an applied coating substantially increase maintenance costs and liabilities associated with the structure surface.

There is a need, therefore, for a new surface treatment composition and method for using same that can remove all surface contaminants, does not require multiple blasting processes, does not require environmental control and/or dehumidification, does not require a holding primer, provides a suitable surface to apply protective coatings, and does so in a single application step.

SUMMARY

Embodiments of the present disclosure provide surface treatment compositions and methods for making and using same. One such composition can be used for removing contaminants from a metallic surface and can include about 3 wt % to about 40 wt % of at least one bifunctional alkaline compound, about 0.03 wt % to about 10 wt % of at least one oxidizer comprising a metal salt and water, where all weight percentages are based on the total weight of the composition.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments. It is emphasized that the figures are not necessarily to scale and certain features and certain views of the figures can be shown exaggerated in scale or in schematic for clarity and/or conciseness.

DETAILED DESCRIPTION

Figure 1:
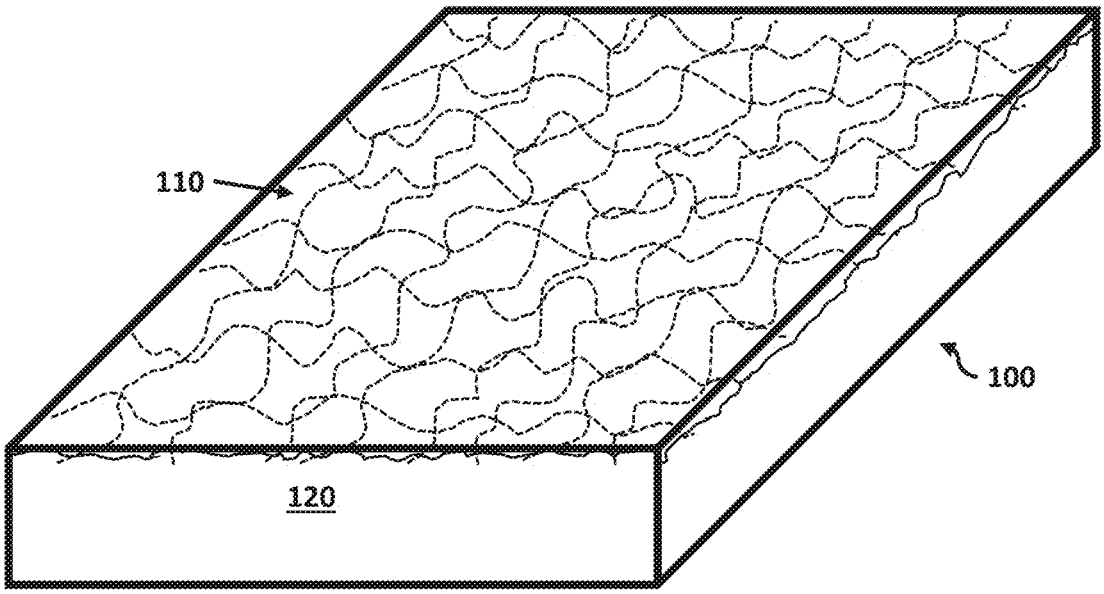
FIG. 1 depicts a schematic perspective view of a metallic substrate that has been treated using the compositions provide herein, according to one or more embodiments provided.

Each of the appended claims defines a separate invention, which for infringement purposes is recognized as including equivalents to the various elements or limitations specified in the claims. Depending on the context, all references to the "invention" may in some cases refer to certain specific embodiments only. In other cases, it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this disclosure is combined with publicly available information and technology.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure can repeat reference numerals and/or letters in the various embodiments and across the figures provided herein. This repetition is for the purpose of simplicity and clarity and does not in itself dictate a relationship between the various embodiments and/or configurations. Moreover, the formation of a first feature over or on a second feature in the description that follows can include embodiments in which the first and second features are formed in direct contact, and can also include embodiments in which additional features can be formed interposing the first and second features, such that the first and second features are not in direct contact. Finally, the embodiments presented below can be combined in any combination of ways, i.e., any element from one embodiment can be used in any other embodiment, without departing from the scope of the disclosure.

Additionally, certain terms are used throughout the following description and claims to refer to particular components. As one skilled in the art will appreciate, various entities can refer to the same component by different names, and as such, the naming convention for the elements described herein is not intended to limit the scope of the invention, unless otherwise specifically defined herein. Further, the naming convention used herein is not intended to distinguish between components that differ in name but not function.

The terms "including" and "comprising" are used in an open-ended fashion, and thus should be interpreted to mean "including, but not limited to." The phrase "consisting essentially of" means that the described/claimed composition does not include any other components that will materially alter its properties by any more than 5% of that property, and in any case, does not include any other component to a level greater than 3 wt %.

The term "or" is intended to encompass both exclusive and inclusive cases, i.e., "A or B" is intended to be synonymous with "at least one of A and B," unless otherwise expressly specified herein.

The indefinite articles "a" and "an" refer to both singular forms (i.e., "one") and plural referents (i.e., one or more) unless the context clearly dictates otherwise.

The term "contaminant" as used herein refers to both chemical and microbiological sources that can corrode a surface or destroy an applied coating. Examples of contaminants include, but are not limited to, MIC (microbiologically influenced corrosion), rust and other oxides, chlorides, sulfates, nitrates and sulfides deposited or otherwise found on a metallic surface.

The term "metallic surface" as used herein refers to any surface containing a metal, including metal alloys. Illustrative metals can be or can include galvanized steel, carbon steel, stainless steel, iron, titanium, nickel, copper, brass, chromium, molybdenum, or the like, or any combination therein. A preferred metallic surface can be or can include galvanized steel, carbon steel, stainless steel, iron, or any combination therein.

The following detailed description illustrates embodiments of the present disclosure. These embodiments are described in sufficient detail to enable a person of ordinary skill in the art to practice these embodiments. It should be understood, however, that the embodiments and examples described herein are given by way of illustration only, and not by way of limitation, the embodiments are chosen and described so that others skilled in the art may appreciate and understand the principles and practices of the present teachings. Various substitutions, modifications, additions, and rearrangements can be made that remain potential applications of the disclosed processes. Therefore, the description that follows is not to be taken as limiting on the scope of the appended claims. In particular, an element associated with a particular embodiment should not be limited to association with that particular embodiment but should be assumed to be capable of association with any embodiment discussed herein.

A new surface treatment composition and method for using same are provided herein. The new composition can remove surface contaminants, does not require multiple blasting processes, does not require environmental control and/or dehumidification, does not require a holding primer, provides a suitable surface to apply protective coatings, and does so in a single application step. It has been surprisingly and unexpectedly discovered that a surface treatment composition containing at least one oxidizer in combination with an alkaline compound and water can effectively remove ferric contaminants from a surface of a metal structure, which significantly increases the serviceable life of the structure.

The at least one oxidizer is metal based. Suitable metals include alkali metals, alkaline earth metals or mixtures thereof. The at least one oxidizer can be or can include a metal salt of an organic or inorganic acid. The organic or inorganic acid can be aliphatic, cycloaliphatic, aromatic, or mixtures thereof. The acid is preferably a sulfur acid, nitric acid, carboxylic acid, phosphorus acid, or mixtures thereof. Particularly preferred acids are oxyacids, meaning the acid contains at least one oxygen atom.

The metal can be or can include sodium, calcium, magnesium, potassium, or ammonium. The metal salt can be derived from or can include derivations of sodium, calcium, magnesium, potassium, or ammonium, and at least sulfur acid, a carboxylic acid, a phosphorus acid, or mixtures thereof. Suitable metal salts can also be derived from or can include derivations of sodium and sulfur acid, including peroxysulfuric acid.

A particularly suitable metal salt is sodium persulfate due to its stability, cost, low environmental impact, and application versatility as either a powder or liquid composition. Sodium persulfate is an inorganic compound with the formula $Na_2S_2O_8$. This is a salt of sodium metal (Na) and peroxysulfuric acid, $H_2S_2O_8$, and acts as an oxidizing agent. Sodium persulfate is a white solid that dissolves in water. It is almost non-hygroscopic and has a good shelf life. Sodium persulfate has a pH value of 3, its flash point is non-flammable, and does not present an explosion hazard. Other metal salts having similar pH and flash points can be used as well.

The surface treatment composition can contain from about 0.03 wt % to about 10 wt % of the at least one oxidizer. For example, the amount of the oxidizer can range from a low of about 0.03 wt %, about 0.5 wt %, or about 1 wt %, to a high of about 3 wt %, about 5 wt %, or about 10 wt %. The amount of the oxidizer can also be about 0.01 wt % to about 10 wt %; about 0.01 wt % to about 15 wt %; or about 0.03 wt % to about 15 wt %. All weight percentages stated herein are based on the total weight of the composition unless expressly stated otherwise.

The surface treatment composition also includes at least one alkaline compound. The alkaline compound can be or can include any one or more basic compounds that are non-volatile, environmentally benign, and soluble. The alkaline compound can be bifunctional, meaning it can include two or more functional groups. Suitable functional groups can include alkanes, alkenes, alkynes, hydroxyls, alcohols, aldehydes, ketones, carbonates, carboxylates, ethers, esters, amides, and amines.

A suitable alkaline compound has a pH greater than 7. For example, a suitable alkaline compound has a pH of greater than 8, greater than 9, greater than 10, or greater than 10.5 or greater than 11. A suitable alkaline compound can have a pH of about 8, about 8.5 or about 9 to about 10, about 10.5 or about 11.2.

Suitable bifunctional alkaline compounds can be or can include monoethanolamine (MEA), diethanolamine, triethanolamine, dimethylaminoethanol, diethylaminoethanol, 2-amino-2-methyl-1-propanol, N-(aminoethyl)ethanolamine, N,N-dimethyl-2-aminoethanol, 2-(2-aminoethoxy)ethanol, tetramethylammonium hydroxide, tetraethylammonium hydroxide, tetrapropylammonium hydroxide, tetrabutylammonium hydroxide, tributylmethylammonium hydroxide, benzyltrimethylammonium hydroxide, hydroxyamine, trimethylethylammonium hydroxide, diethyldimethylammonium hydroxide, and combinations thereof. Preferred bifunctional alkaline compounds can be or can include dimethylaminoethanol (DMAE or DMEA) due to its cost, low environmental impact, and fugitive quality. A fugitive compound is a compound that becomes partially or completely inert during or after a chemical process.

Dimethylaminoethanol (DMAE or DMEA) is an organic compound with the formula $(CH_3)_2NCH_2CH_2OH$. DMAE is bifunctional, containing both a tertiary amine and primary alcohol functional groups. DMAE is a colorless viscous liquid, and can be prepared by the ethoxylation of dimethylamine DMAE has a pH greater than 7 and is typically greater than 10, or greater than 10.5 or greater than 11.

The surface treatment composition can contain from about 3 wt % to about 40 wt % of the at least one alkaline compound. For example, the amount of the alkaline compound can range from a low of about 2.5 wt %, about 3 wt %, or about 3.5 wt %, to a high of about 35 wt %, about 40 wt %, or about 45 wt %. The amount of the alkaline compound can also be about 1.5 wt % to about 40 wt %; about 1.5 wt % to about 50 wt %; or about 3 wt % to about 50 wt %.

The surface treatment composition can further include at least one surfactant. The at least one surfactant can be or can include any non-ionic material that can reduce water surface tension. For example, a suitable surfactant can include one or more derivatized fatty alcohols, including any one or more fatty alcohol ethoxylates, alkyl phenol ethoxylates and fatty acid alkoxylates. Reducing water tension aids in reducing reaction time as well as increasing pump life of the one step process delivery system. When used, up to about 1 wt %, 500 ppmw or 100 ppmw, or 50 ppmw, or 20 ppmw, or 10 ppmw, or 5 ppmw, or 1 ppmw of a surfactant can be added to the surface treatment composition, where "ppmw" is parts per million by weight.

The surface treatment composition can have a pH of about 9 to about 12. For example, the pH of the surface treatment composition can range from a low of about 8.5, about 9, or about 9.5, to a high of about 11.5, about 12, or about 12.5. The pH of the surface treatment composition can also be about 8 to about 12; about 9 to about 12; or about 10 to about 11.

The surface treatment composition can further include water. The water can be or can include deionized water, purified water, demineralized water, distilled water, or combinations thereof. Preferred water can be or can include distilled water with less than about 100 ppmw of chlorine. For example, the weight of chlorine in the distilled water can be about 80 ppmw, about 100 ppmw, or about 120 ppmw. The weight of chlorine in the distilled water can also be about 20 ppmw, 50 ppmw, 75 ppmw, 125 ppmw, or 150 ppmw. Preferably, the water is chlorine free or substantially chlorine free.

Water can be distilled by any suitable process such as evaporation, boiling, filtration, reverse osmosis, or the like. Common filtration processes can include activated carbon filters, catalytic carbon filters, or the like. A preferred filtration process uses activated carbon filters due to their cost, chlorine capture, and ease of use.

The surface treatment composition can contain from about 60 wt % to about 95 wt % water. For example, the amount of water can range from a low of about 60 wt %, about 65 wt %, or about 68 wt %, to a high of about 72 wt %, about 78 wt %, or about 88 wt %. The amount of water can also be about 60 wt % to about 90 wt %; about 65 wt % to about 85 wt %; or about 70 wt % to about 80 wt %.

Water can be added to the oxidizer and alkaline compound solution to provide a diluted mixture having a composition to water ratio of about 1:50 to about 1:150. For example, the ratio of the oxidizer and alkaline compound solution to water can range from a low of about 1:45, about 1:50, or about 1:55, to a high of about 1:135, about 1:150, or about 1:165. The ratio can also be about 1:40 to about 1:150; about 1:40 to about 1:175; about 1:50 to about 1:175; about 1:70 to about 1:150; or about 1:80 to about 1:120.

The diluted mixture can have a pH of about 9 to about 11.5. For example, the pH of the diluted mixture can range from a low of about 8.5, about 9, or about 9.5, to a high of about 10.5, about 11, or about 11.5. The pH of the diluted mixture can also be about 9.2 to about 11.5; about 9.8 to about 11; or about 10 to about 11.

The surface treatment composition provided herein can be applied directly on a metallic surface to be treated as a concentrate (i.e. the oxidizer, alkaline compound, and optional surfactant solution) or as a diluted mixture with water. The concentrate/diluted mixture reacts with the metallic surface to form a passivated metal oxide layer on the metallic surface.

The passivated metal oxide layer is an oxidized or otherwise generally chemically inert substance formed when passivating the metallic surface. The passivated metal oxide layer can include iron oxide, titanium oxide, nickel oxide, copper oxide, chromium oxide, molybdenum oxide, or the like, or any combination thereof. The preferred passivated metal oxide layer can include ferrous oxide, ferric oxide, ferrous carbonate, or ferric carbonate.

As used herein, the term "passivation" refers to a process by which a surface is treated or coated to reduce the chemical reactivity of the surface, thereby reducing the corrosion effect of environmental contaminants. Passivation creates an outer layer of material by chemical reaction with a metallic surface, either by process or spontaneous oxidation in the air. Passivation can also occur when a surface is coated and reacted with the compound provided herein (as a concentrate or diluted mixture) and with the surrounding environment to form a passivated layer on the surface after drying. The outer layer of material created is typically an inert material, that is a material that has significantly reduced or no chemical reactivity. For example, a passivation process produces a layer of ferrous (or ferric) oxide on an iron-containing metallic surface which creates an inert, passivated iron oxide layer on the metallic surface that is resistant to corrosion and prevents contaminants from reaching the bulk metal beneath the passivated iron oxide layer.

The method for metal decontamination using the surface treatment composition provided herein can further include blasting the metallic surface with an abrasive material while depositing the diluted mixture on the metallic surface. Blasting the metallic surface can be done by wet abrasive blasting, wet abrasive vapor blasting, high pressure water blasting, ultra-high pressure water blasting, or the like. Wet abrasive blasting and wet abrasive vapor blasting effectively can clean the metallic surface by encapsulating grit media in a water matrix before the grit media impacts the metallic surface to remove contaminants. The water matrix can include water and any other chemical solution appropriate for wet abrasive blasting or wet abrasive vapor blasting. The preferred water matrix can be the dilute mixture. Wet abrasive blasting and wet abrasive vapor blasting can use air pressure between 40 psi and 125 psi. High pressure water blasting and ultra-high pressure water blasting effectively clean a surface by ejecting a water matrix at high speeds against the metallic surface with sufficient force to remove contaminants. High pressure water blasting can use air pressure between 5,000 psi and 20,000 psi and ultra-high pressure water blasting can use air pressure 20,000 psi and 65,000 psi. Wet abrasive blasting, wet abrasive vapor blasting, high pressure water blasting, ultra-high pressure water blasting, and the like are advantageous to use over conventional forms of sand blasting because sand blasting deposits dust and grit into the air and the area surrounding the surface site.

The passivated metal oxide layer eliminates the need for an added corrosion inhibitor. The compound provided herein, when applied to a metallic surface to be treated (as a concentrate or diluted mixture), forms an amorphous oxide layer that protects the surface against incidental or non-incidental cross contamination or other environmental influences. Said another way, the amorphous oxide layer protects the surface against casual or non-casual cross contamination or other environmental influences. The passivated metal oxide layer that is formed is an adduct or a highly electron receptive surface. The passivated metal oxide layer is highly receptive to protective coatings or paint, including any epoxy, polysiloxane, polyamide, or polyester based coatings or paints. The passivated oxide layer can have a thickness of about 1 nm to about 100 nm; or about 2 nm to about 80; or about 5 nm to about 75; or about 10 nm to about 50; or about 15 nm to about 30 nm. The passivated metal oxide layer can also have a thickness 220 of about 8 nm, 9 nm, or 10 nm to about 32 nm, 35 nm, or 40 nm.

FIG. 1 depicts a schematic perspective view of a metallic substrate 100 that has been treated using the surface treatment composition provided herein, according to one or more embodiments. The metallic substrate 100 can be made from one or more metals or one or more metal alloys or any combination thereof. The outermost surface can include a passivated metal oxide layer 110 disposed on or over an underlying substrate layer 120. The passivated metal oxide layer 110 is amorphous, and can be continuous or intermittent across the substrate layer 120. The passivated metal oxide layer 110 is receptive to protective coatings or paint.

Figure 2:
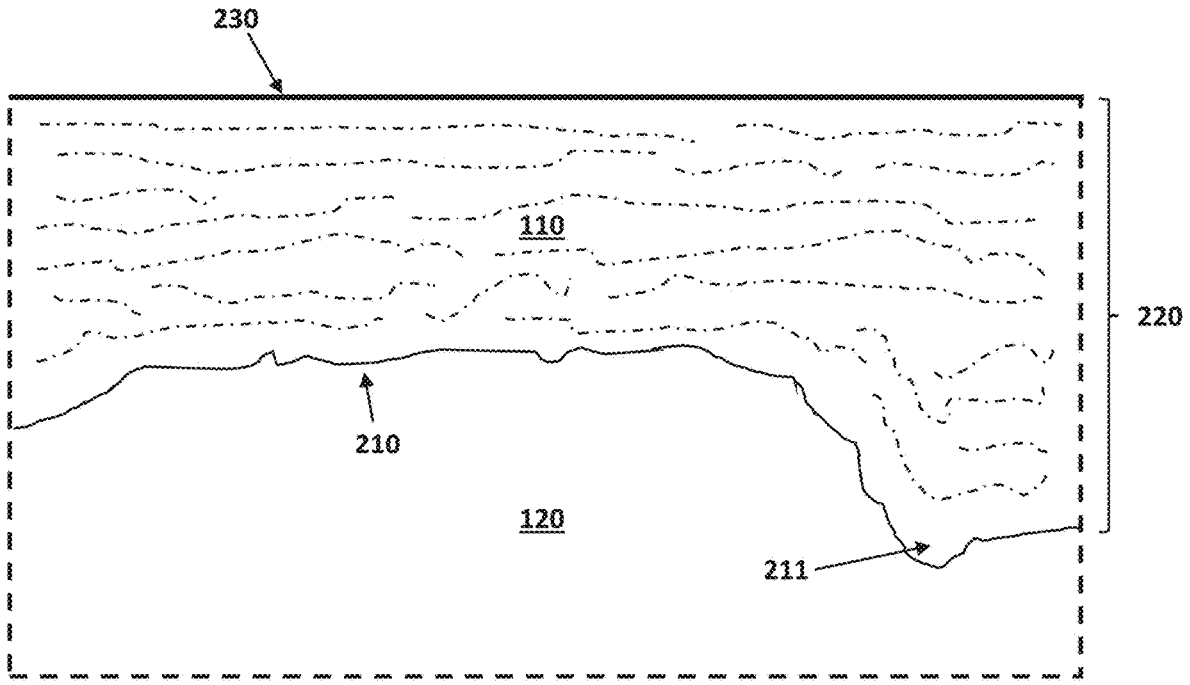
FIG. 2 depicts an illustrative enlarged cross-sectional view of a metallic substrate according to one or more embodiments provided.
Figure 3:
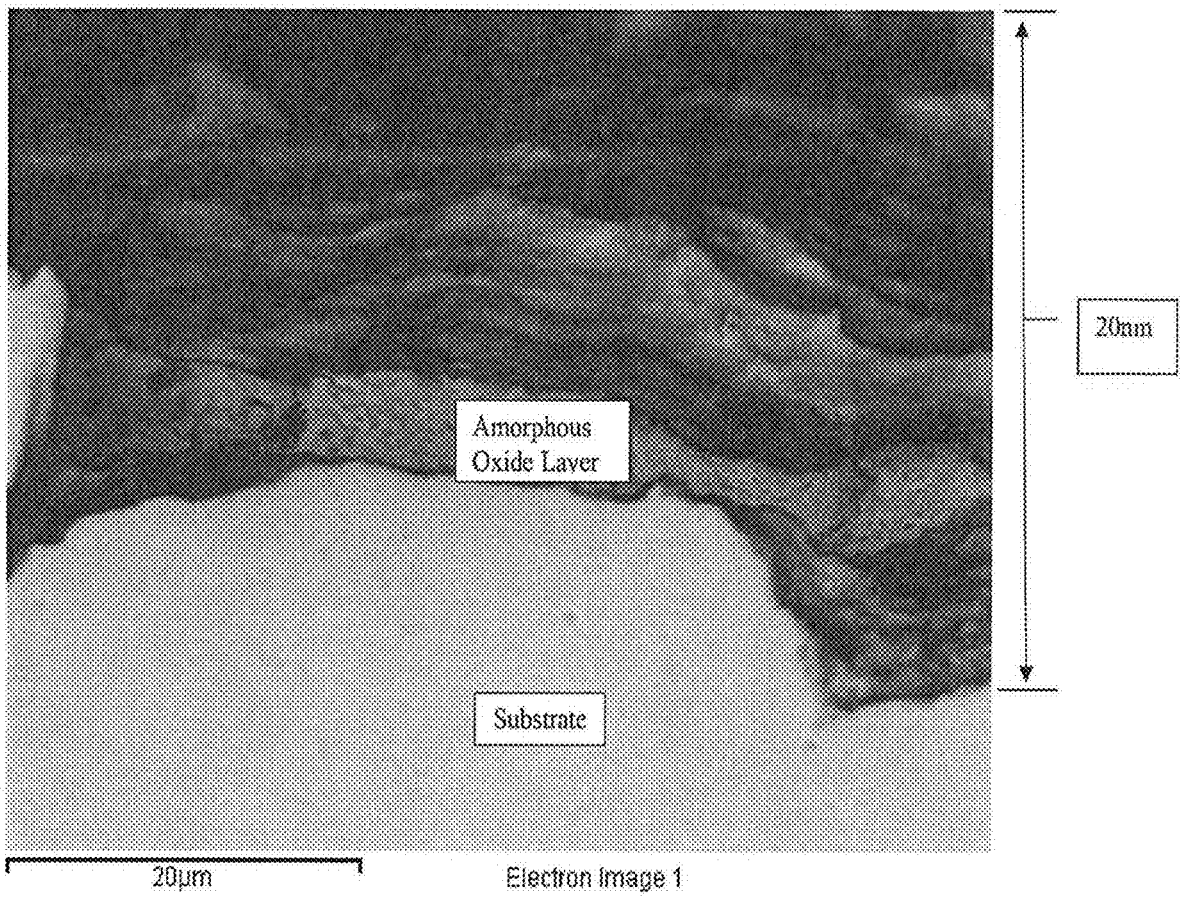
FIG. 3 is an illustrative electron image of a metallic surface, according to one or more embodiments provided herein.

FIG. 2 depicts an illustrative magnified cross-sectional view of the metallic substrate 100 depicted in FIG. 1. The substrate layer 120 can have an upper surface 210. The passivated metal oxide layer 110 can have an outermost or upper surface 230. The substrate surface 210 can be non-uniform and can include one or more pits or other indentions 211, including grooving or other chemical or physical forms of surface alteration. The passivated metal oxide layer 110 directly contacts the substrate surface 210. The passivated metal oxide layer 110 is located between the substrate surface 210 and the upper surface 230. FIG. 3 depicts an illustrate electron image of a metallic substrate 100 showing an amorphous metal oxide layer 110 disposed on the substrate layer 120.

Figure 4:
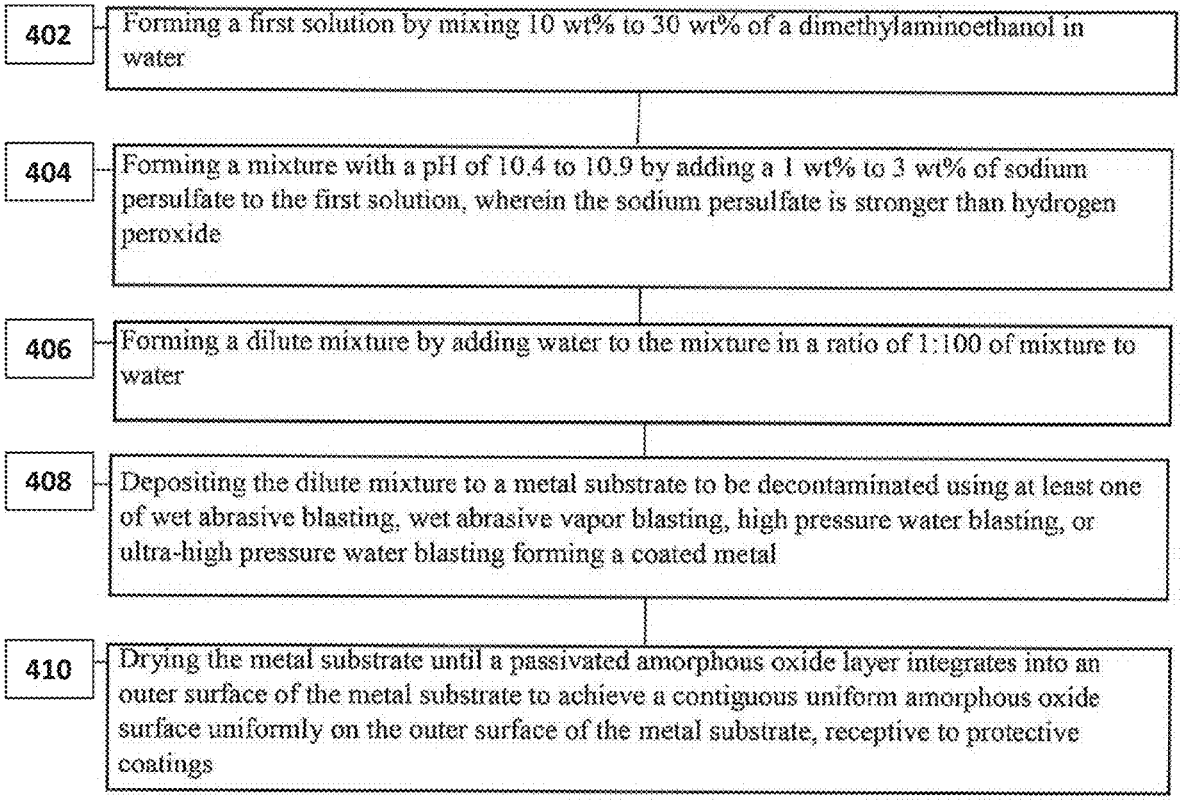
FIG. 4 depicts steps to a method for removing contaminants from a metallic surface according to one or more embodiments provided herein.

FIG. 4 provides a visual representation of the steps to a method for removing contaminants from a metallic surface according to one or more embodiments provided herein. Each step of the method can be performed prior to transport to a work site or can be performed in-situ. Each step of the method is safe to perform and produces nontoxic material to humans and the environment. The surface treatment composition provided herein allows for the removal of reactive sites of contamination on the substrate surface 210 and the application of a passivated metal oxide layer 110 to the substrate surface 210 in a single step, as further explained below.

A first solution can be formed in Step 402. The first solution can be made by mixing the alkaline compound and the oxidizer and optionally a surfactant, in Step 404. Water can be added to the solution of Step 404 to provide a dilute mixture, in Step 406.

The dilute mixture of Step 406 can then be applied or otherwise deposited onto a metal substrate to be decontaminated using at least one technique selected from wet abrasive blasting, wet abrasive vapor blasting, high pressure water blasting, and ultra-high pressure water blasting to form a coated metal, in Step 408. The coated metal can then be dried or allowed to air dry to provide a passivated amorphous metal oxide layer on an outer surface of the metal substrate (Step 410). The amorphous metal oxide layer can form a contiguous, uniform amorphous oxide surface on the outer surface of the metal substrate, which is highly receptive to a protective coating or paint.

The surface treatment composition can be used for removing contamination or rust from pipes, pipelines, vessels, tanks, reactors, cars, trucks, boats, ship, rockets, wellbores, casing, and other things made from metal or metallic alloys that are susceptible to surface corrosion. Not wishing to be bound by theory, it is believed that the passivated metal oxide layer is a Lewis adduct that is formed on the metallic surface. The Lewis adduct is a reaction product of a Lewis acid and a Lewis base. A Lewis base is any species that donates a pair of electrons to a Lewis acid to form a Lewis adduct, and a Lewis acid is any species that receives the pair of donated electrons. As such, a Lewis acid and Lewis base share an electron pair thereby forming a Lewis adduct. This Lewis acid formation is electron receptive and provides a surface that has far greater adhesion to subsequent coatings and paint that are electron donors.

The surface treatment composition is particularly useful for removing sulfur contamination from metallic surfaces. Metallic surfaces in contact with salt water, marine organisms, bacteria, waste water, soil, or hydrocarbons, for example, are particularly susceptible to sulfur deposits and contamination on the surface. The oxygen atoms in the composition can react with the sulfur atoms and effectively remove the sulfur, leaving behind a passivated metal oxide surface that is highly receptive of a coating and/or paint.

The single step application process using the compound described herein decontaminates metallic surfaces at the molecular level, eliminating visually undetectable levels of highly corrosive substances, providing a uniform receptive surface prior to the application of coatings or paint. The compound reacts and solubilizes the metal sulfide, e.g. FeS, with an acid/oxidation process and solubilizes the ionically bonded metal chloride, e.g. $FeCl_2$, aggregated on the metal substrate. The compound also reacts and solubilizes any metal sulfate ($SO^{2-}$) and nitrate ($NO^{-}_3$), if present.

The compound provided herein attacks the cations and insoluble sulfides and chemically breaks the ionic attraction between the anions and cations, eliminating the cathode-anode reaction (i.e. corrosion reaction). As a result, the compound leaves behind a contaminant free substrate. The compound also does not react in solution, only with the aggregated cations and anions on the metallic surface. The compound also leaves no film to interfere with coating adhesion at the coating to substrate interface.

EXAMPLES

Embodiments discussed and described herein can be further described with the following examples. Although the examples are directed to specific embodiments, they are not to be viewed as limiting in any specific respect.

Three surface treatment compositions (Comp. 1-3) were prepared in accordance with one or more embodiments described above. Each composition was prepared by dissolving the sodium persulfate in one Liter of deionized water, followed by stirring, followed by the addition of DMAE and then the derivatized fatty alcohol was added drop wise (one drop=0.05 grams), followed by more stirring to form a concentrate. The concentrate was then diluted with more deionized water to a ratio of 100 parts of water to 1 part of the concentrate. The derivatized fatty alcohol was nonionic and was obtained from Reliant Technologies located in Port Allen, La.

Table 1 below summarizes the concentrate compositions of each example and Table 2 summarizes the diluted mixture.

TABLE 1

Composition Summary of the Concentrate.

| | Sodium Persulfate | DMAE | Fatty Alcohol | DI Water |
|---|---|---|---|---|
| Comp. 1 | 37.85 g | 757 mL | 1 ppmv | 1 L |
| Comp. 2 | 56.4 g | 908.4 mL | 5 ppmv | 1 L |
| Comp. 3 | 113.55 g | 1,135.5 mL | 10 ppmv | 1 L |

TABLE 2

Composition Summary of the Diluted Mixture (100:1).

| | Sodium Persulfate | DMAE | Fatty Alcohol | DI Water | pH |
|---|---|---|---|---|---|
| Comp. 1 | 1 wt % | 20 wt % | 1 ppmw | 79 wt % | 10.4-10.9 |
| Comp. 2 | 1.49 wt % | 24 wt % | 5 ppmw | 74.5 wt % | 10.4-10.9 |
| Comp. 3 | 3 wt % | 30 wt % | 10 ppmw | 67 wt % | 10.4-10.9 |

Each diluted mixture was then sprayed on external surfaces of a 10 foot steel pipe having a diameter of 18 inches. Each pipe was dried for up to 1 hour at 12.8° C., allowing an uniform passivated amorphous oxide layer of 12 nm to 32 nm to form onto the outer surface of the pipe. Each pipe was then coated with an epoxy-based coating, and then stored in a salt water immersion for 360 days. The pipes were retrieved and visually inspected. No breaches in the coated surfaces were observed.

Embodiments of the present disclosure further include any one or more of the following numbered paragraphs:

1. A composition for removing contaminants from a metallic surface, comprising 3 wt % to 40 wt % of at least one bifunctional alkaline compound; 0.03 wt % to 10 wt % of at least one oxidizer comprising a metal salt; and water, wherein all weight percentages are based on the total weight of the composition.

2. The composition of paragraph 1, wherein the at least one bifunctional alkaline compound comprises a tertiary amine and a hydroxyl group.

3. The composition of paragraphs 1 or 2, wherein the hydroxyl group is a primary alcohol.

4. The composition according to any paragraph 1 to 3, wherein the at least one bifunctional alkaline compound comprises dimethylethanolamine (DMAE or DMEA).

5. The composition according to any paragraph 1 to 4, wherein the metal salt comprises sodium, potassium, or ammonium.

6. The composition according to any paragraph 1 to 5, wherein the metal salt is derived from sodium and at least one sulfuric acid.

7. The composition according to any paragraph 1 to 6, wherein the metal salt is derived from sodium and peroxysulfuric acid.

8. The composition according to any paragraph 1 to 7, wherein the metal salt is sodium persulfate.

9. The composition according to any paragraph 1 to 8, wherein the water comprises less than about 100 ppmv of chlorine.

10. The composition according to any paragraph 1 to 9, wherein the composition has a pH of about 9 to about 12.

11. The composition according to any paragraph 1 to 10, wherein the composition further comprises a surfactant.

12. A composition for removing contaminants from a metallic surface, comprising 10 wt % to 30 wt % of dimethylaminoethanol; 1 wt % to 3 wt % of sodium persulfate; and water, wherein all weight percentages are based on the total weight of the composition.

13. The composition of paragraph 12, wherein the water comprises less than 100 ppmv of chlorine.

14. The composition of paragraphs 12 or 13, wherein the composition has a pH of about 9 to about 12.

15. A method for metal decontamination, comprising providing an aqueous solution comprising 10 wt % to 30 wt % of dimethylaminoethanol, 1 wt % to 3 wt % of sodium persulfate, and water, wherein the aqueous solution has a pH of about 9 to about 12; adding additional water to the solution such that a ratio of the solution to the additional water ranges from about 1:50 to about 1:150 to provide a diluted mixture having a pH of 10.4 to 10.9; and reacting the diluted mixture with a metallic surface to form a passivated metal oxide layer on the reacted metallic surface.

16. The method of paragraph 15, further comprising blasting the metallic surface with an abrasive material while depositing the diluted mixture on the metallic surface.

17. The method of paragraph 16, wherein blasting the metal substrate is done by wet abrasive blasting, wet abrasive vapor blasting, high pressure water blasting, or ultra-high pressure water blasting.

18. The method according to any paragraph 15 to 17, wherein the passivated metal oxide layer comprises ferrous oxide, ferric oxide, or ferric carbonate.

19. The method according to any paragraph 15 to 18, wherein the passivated metal oxide layer has no added corrosion inhibitor.

20. The method according to any paragraph 15 to 19, further comprising distilling the water prior to use.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, meaning the values take into account experimental error, machine tolerances and other variations that would be expected by a person having ordinary skill in the art.

The foregoing has also outlined features of several embodiments so that those skilled in the art can better understand the present disclosure. Those skilled in the art should appreciate that they can readily use the present disclosure as a basis for designing or modifying other methods or devices for carrying out the same purposes and/or achieving the same advantages of the embodiments disclosed herein. Those skilled in the art should also realize that such equivalent constructions do not depart from the spirit and scope of the present disclosure, and that they can make various changes, substitutions, and alterations herein without departing from the spirit and scope of the present disclosure, and the scope thereof is determined by the claims that follow.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

What is claimed is:

1. An alkaline composition for removing contaminants from a metallic surface, consisting of:

at least one bifunctional alkaline compound that comprises a tertiary amine and a hydroxyl group;

at least one oxidizer derived from a metal salt;

up to 1 wt % of a surfactant; and water comprising less than 100 ppm chlorine, wherein the composition has a pH of about 9 to about 11.5 and all weight percentages are based on the total weight of the composition.

2. The composition of claim 1, wherein the hydroxyl group is a primary alcohol.

3. The composition of claim 1, wherein the at least one bifunctional alkaline compound comprises dimethylethanolamine (DMAE).

4. The composition of claim 1, wherein the metal salt comprises sodium, potassium, or ammonium.

5. The composition of claim 1, wherein the metal salt is derived from sodium and at least one sulfuric acid.

6. The composition of claim 1, wherein the metal salt is derived from sodium and peroxy sulfuric acid.

7. The composition of claim 1, wherein the metal salt is sodium persulfate.

8. The composition of claim 1, wherein the water comprises less than about 100 ppmw of chlorine.

9. The composition of claim 1, wherein the composition has a pH of about 10 to about 11.

10. The composition of claim 1, wherein the surfactant comprises one or more derivatized fatty alcohols.

11. An alkaline composition having a pH of about 9 to about 12 for removing contaminants from a metallic surface, consisting of:

dimethylaminoethanol;

sodium persulfate;

up to 1 wt % of a surfactant;

and water, wherein all weight percentages are based on the total weight of the composition.

12. The composition of claim 11, wherein the water comprises less than 100 ppmw of chlorine.

13. The composition of claim 11, wherein the surfactant comprises one or more derivatized fatty alcohols.

* * * * *